US008100287B2

(12) United States Patent
Milnark

(10) Patent No.: US 8,100,287 B2
(45) Date of Patent: Jan. 24, 2012

(54) CAPS FOR DRINKING VESSELS

(76) Inventor: Veronica Milnark, Port Clinton, OH (US)

( * ) Notice: Subject to any disclaimer, the term of this patent is extended or adjusted under 35 U.S.C. 154(b) by 925 days.

(21) Appl. No.: 12/023,671

(22) Filed: Jan. 31, 2008

(65) Prior Publication Data

US 2008/0190945 A1 Aug. 14, 2008

Related U.S. Application Data

(60) Provisional application No. 60/889,098, filed on Feb. 9, 2007.

(51) Int. Cl.
*B65D 25/34* (2006.01)

(52) U.S. Cl. ..... 220/709; 215/317; 215/319

(58) Field of Classification Search ..... 220/709, 220/705, 711, 713, 714, 287; 206/459.1, 206/807; 215/317, 319, 320, 321, 323, 324, 215/326, 341

See application file for complete search history.

(56) References Cited

U.S. PATENT DOCUMENTS

| | | | | | |
|---|---|---|---|---|---|
| 976,516 | A | * | 11/1910 | Spiller | 206/445 |
| 1,243,033 | A | | 10/1917 | Beatty | |
| 1,543,427 | A | | 6/1925 | Denney | |
| 3,822,030 | A | | 7/1974 | Tanzer | |
| 3,862,614 | A | * | 1/1975 | Kovac | 215/317 |
| 3,874,554 | A | * | 4/1975 | Chang | 220/708 |
| 4,074,827 | A | * | 2/1978 | Labe, III | 220/522 |
| 4,542,833 | A | * | 9/1985 | DeVaughn | 215/319 |
| 4,901,881 | A | * | 2/1990 | McElroy | 220/287 |
| 5,036,994 | A | * | 8/1991 | McElroy | 220/212 |
| 5,370,253 | A | * | 12/1994 | Kite | 215/326 |
| 5,405,033 | A | * | 4/1995 | Sweed | 215/306 |
| 5,495,944 | A | * | 3/1996 | Lermer | 206/459.1 |
| 5,553,733 | A | | 9/1996 | Rosenthal | |
| 5,666,972 | A | | 9/1997 | Gifford | |
| 5,984,135 | A | | 11/1999 | Brown | |
| 6,276,551 | B1 | | 8/2001 | Miller, II | |
| 6,302,288 | B1 | * | 10/2001 | Nava et al. | 220/212 |
| 6,786,346 | B1 | | 9/2004 | Gurnard et al. | |
| 2004/0195254 | A1 | | 10/2004 | Bunkers | |
| 2006/0144730 | A1 | | 7/2006 | Greenberg | |

FOREIGN PATENT DOCUMENTS

| | | |
|---|---|---|
| EP | 1591371 | 11/2005 |
| EP | 1591372 | 11/2005 |
| EP | 1681244 | 7/2006 |
| GB | 2409449 | 6/2005 |
| GB | 2414017 | 11/2005 |
| GB | 2414229 | 11/2005 |
| GB | 2403715 | 12/2005 |
| GB | 2416349 | 1/2006 |
| GB | 2405141 | 2/2006 |
| GB | 2416765 | 2/2006 |

(Continued)

*Primary Examiner* — J. Gregory Pickett
*Assistant Examiner* — Andrew Perreault
(74) *Attorney, Agent, or Firm* — Rankin, Hill & Clark LLP

(57) ABSTRACT

The present invention provides a cap for covering the open top of a drinking vessel. The cap includes a substantially rigid cover disk assembly dimensioned to span across and substantially cover the open top of the drinking vessel, and a flexible tubular membrane that extends from a bottom side of the cover disk assembly. The membrane is adapted to be rolled down a side wall of the drinking vessel to thereby removably secure the cap thereto. Identifying indicia can be printed on the top side of the cover disk assembly. The beverage within the drinking vessel can be consumed using a drinking straw. When properly deployed, the cap inhibits the introduction of unwanted matter into the drinking vessel.

19 Claims, 3 Drawing Sheets

FOREIGN PATENT DOCUMENTS

| | | |
|---|---|---|
| GB | 2417879 | 3/2006 |
| GB | 2409201 | 6/2006 |
| WO | 2004/076309 | 9/2004 |
| WO | 2006/00819 | 1/2006 |
| WO | 2006/072786 | 7/2006 |
| WO | 2006/103117 | 10/2006 |

* cited by examiner

CAPS FOR DRINKING VESSELS

CROSS-REFERENCE TO RELATED APPLICATIONS

This application claims the benefit of application Ser. No. 60/889,098, filed Feb. 9, 2007, under 35 U.S.C. §119(e).

BACKGROUND OF INVENTION

1. Field of Invention

The present invention relates generally to caps for drinking vessels.

2. Description of Related Art

Alcoholic beverages, and particularly mixed beverages, are often served in public restaurants, nightclubs, taverns and bars in open top drinking vessels (e.g., bar glasses and stemware). The uncovered opening of such drinking vessels makes it easy for the bar tender to prepare the beverage. However, the uncovered opening also makes it possible for depraved individuals to add an incapacitating substance such as Rohypnol, for example, to a patron's beverage when they are not closely guarding the drinking vessel (e.g., while conversing with another, dancing etc.).

BRIEF SUMMARY OF THE INVENTION

In view of the foregoing, the present invention is directed to a cap for covering the open top of a drinking vessel. The cap according to the invention comprises a substantially rigid cover disk assembly dimensioned to span across and substantially cover the open top of the drinking vessel, and a flexible tubular membrane that extends from a bottom side of the cover disk assembly. The membrane is adapted to be rolled down a side wall of the drinking vessel to thereby removably secure the cap thereto. Identifying indicia can be printed on the top side of the cover disk assembly. The beverage within the drinking vessel can be consumed using a drinking straw. When properly deployed, the cap inhibits the introduction of unwanted matter into the drinking vessel.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
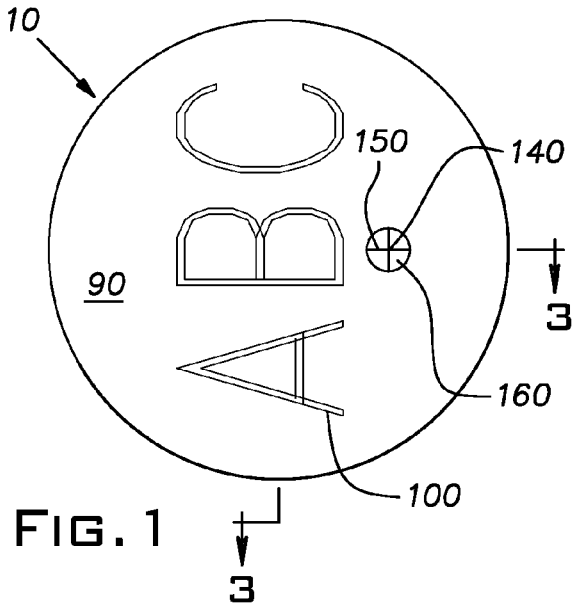
FIG. 1 is a top plan view of a cap for a drinking vessel according to one embodiment of the invention.
Figure 2:
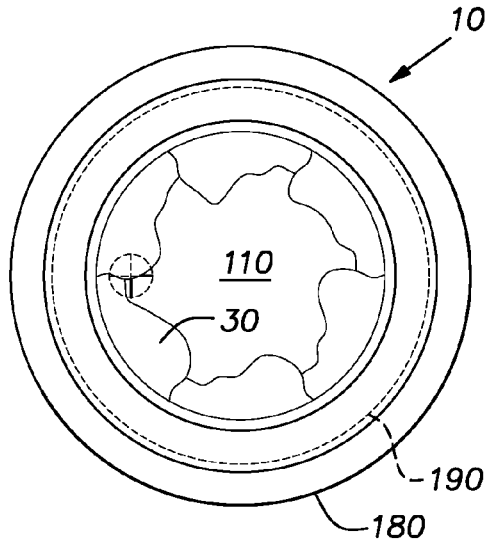
FIG. 2 is a bottom plan view of the cap shown in FIG. 1.
Figure 3:
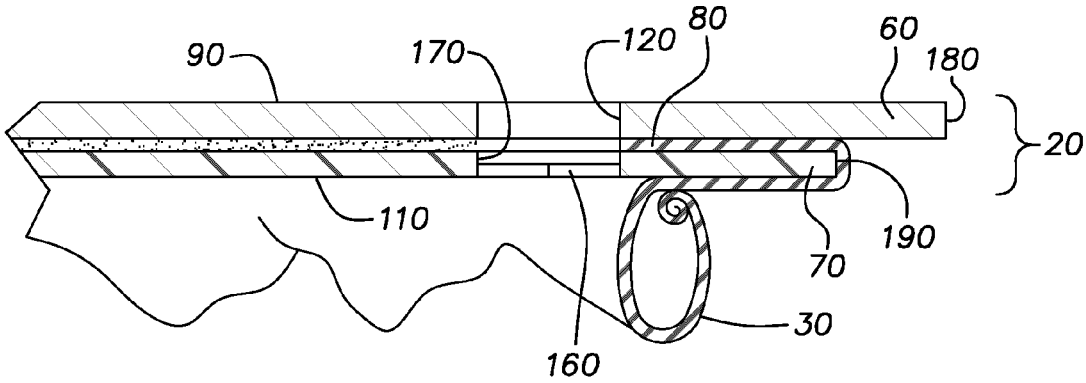
FIG. 3 is a side section view of the cap shown in FIG. 1 taken along the line 3-3.
Figure 4:
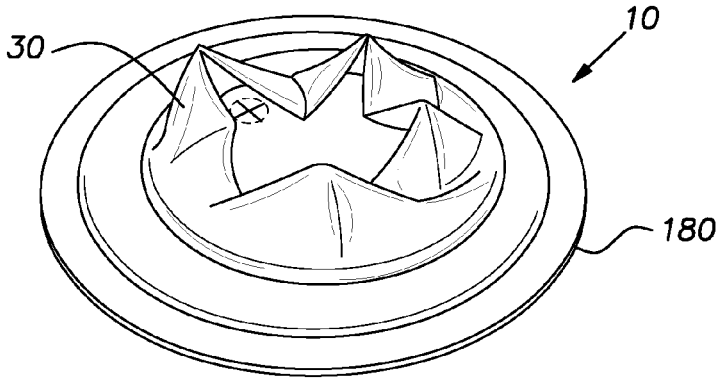
FIG. 4 is a bottom perspective view of the cap shown in FIG. 1.

With reference to the accompanying figures, a cap 10 according to the invention comprises a substantially rigid cover disk assembly 20 having a flexible tubular membrane 30 secured thereto and extending therefrom. The tubular membrane 30 is adapted to be stretched so as to extend around and thus entirely surround and envelope an open-top portion of a drinking vessel 40 such as, for example, a pilsner glass, a pint glass, a cocktail glass, a highball glass or other tumbler, a wine glass or other stemware, or a "pop-top" beverage can. The tubular membrane 30 is also adapted to be unrolled down an outer side wall 50 of the drinking vessel 40 such that the cover disk assembly 20 substantially covers the open top of the drinking vessel 40.

The cover disk assembly 20 is preferably formed of an upper disk portion 60 and a lower disk portion 70, which are joined together with a first end portion 80 of the tubular membrane 30 captured therebetween. The upper disk portion 60 and the lower disk portion 70 are preferably joined together using a suitable adhesive. Alternatively, and less desirably, mechanical fasteners such as staples can be used to join the upper disk portion 60 and the lower disk portion 70 together.

The upper disk portion 60 is preferably formed of a compressed cellulosic material such as paperboard, which may be faced with a thin layer or film of paper or plastic. A top side 90 of the upper disk portion 60 can be printed with decorative and/or informative indicia 100 such as, for example, advertising for products and/or services. The indicia can also be provided on the upper disk portion 60 through the use of adhesive stickers. Preferably, markings can easily be applied to the top side 90 of the upper disk portion 60 using an ink pen or pencil, which allows a patron to further personalize and uniquely identify their beverage.

The lower disk portion 70 is preferably formed of a moisture resistant material such as plastic. Moisture resistant materials are preferred because beverage contents can splash upwardly against the bottom side 110 of the lower disk portion 70. It will be appreciated that the upper disk portion 60 and/or the lower disk portion 70 could be formed of a variety of different materials (e.g., paperboard, light metals, plastics, wood and/or laminates comprising two or more thereof) to form a substantially rigid cover disk assembly 20.

The thickness of the cover disk assembly 20 is not critical, but a thickness within the range of from about 1/16" (~1.6 mm) to about 1/4" (~6.5 mm) is generally believed to be sufficient. In the presently most preferred embodiment of the invention, the cover disk assembly 20 is formed of a flat paperboard upper disk portion 60 having a thickness of about 3/32" (~2.4 mm) that is joined to a flat plastic lower disk portion 70 having a thickness of about 1/16" (~1.6 mm) using an adhesive.

The upper disk portion 60 is provided with a first opening 120 through which an end of a drinking straw 130 can be inserted. The first opening 120 is preferably circular in shape and has an inner diameter that is slightly larger than the outer diameter of the drinking straw 130. It will be appreciated that the shape of the first opening 120 is not critical.

The lower disk portion 70 is provided with a second opening 140 through which the end of the drinking straw 130 can be inserted. The second opening 140 preferably comprises a plurality of intersecting slits 150, which thus form flaps 160 that bias against the drinking straw 130 when the drinking straw 130 is inserted through the second opening 140. The flaps 160 allow the lower disk portion 70 to remain in contact with the drinking straw 130 after the drinking straw 130 has been inserted through the second opening 140, which minimizes any open area between the drinking straw 130 and the lower disk portion 70. It will be appreciated that the number of slits and corresponding flaps is not per se critical.

In the embodiment of the invention shown in FIGS. 1-4, the second opening 140 through the lower disk portion 70 comprises a pair of intersecting slits 150, which intersect at about a 90° angle and thus form four flaps 160 that bias against the drinking straw 130 when the drinking straw passes through the second opening 140. In this embodiment, the slits are provided in a circular recessed area 170. The recessed area 170 reduces the thickness of the lower disk portion 70, which allows the flaps 160 to flex more than if the flaps 160 were thicker, and also helps prevent the slits 150 from tearing beyond the area defined by the recessed area 170. The recessed area 170 also facilitates proper alignment of the upper disk portion 60 with the lower disk portion 70 when the same are joined together. It will be appreciated that an inverse arrangement could be utilized for the first opening and the second opening (i.e., the first opening would include intersecting slits whereas the second opening would be dimensioned sufficiently large enough to allow a drinking straw to pass therethrough).

The upper disk portion 60 has a first perimeter edge portion 180. In the embodiment shown in the accompanying figures, the first perimeter edge portion 180 defines a circle. However, it will be appreciated that the shape defined by the first perimeter edge portion 180 is not critical, and that shapes other than circles can be used. For example, the first perimeter edge portion 180 may be adapted to define a polygon, the border of one or more US States, the border of one or more countries, animal and plant shapes or the shape of advertising logos. Although the shape defined by the first perimeter edge portion 180 is not critical, the first perimeter edge portion 180 of the upper disk portion should define a shape sufficiently large to substantially cover the entire opening of a drinking vessel 40 on which the cap 10 is deployed.

The lower disk portion 70 has a second perimeter edge portion 190. Preferably, the second perimeter edge portion 190 does not include any points or angles that could pierce or cut the tubular membrane 30 that extends around the second perimeter edge portion 190. Thus, the second perimeter edge portion 190 preferably defines a circle, an oval or some other shape having rounded corners. In the most preferred embodiment of the invention, the second perimeter edge portion 190 of the lower disk portion 70 defines a shape that is just slightly larger than the shape of the open-top portion of the drinking vessel 40 onto which the cap 10 is to be deployed. As used in this context, the term "slightly larger" means that the second perimeter edge portion 190 of the lower disk portion 70 extends no more than about ¼" (~6.4 mm) beyond the rim or top edge of the drinking vessel 40.

Figure 7:
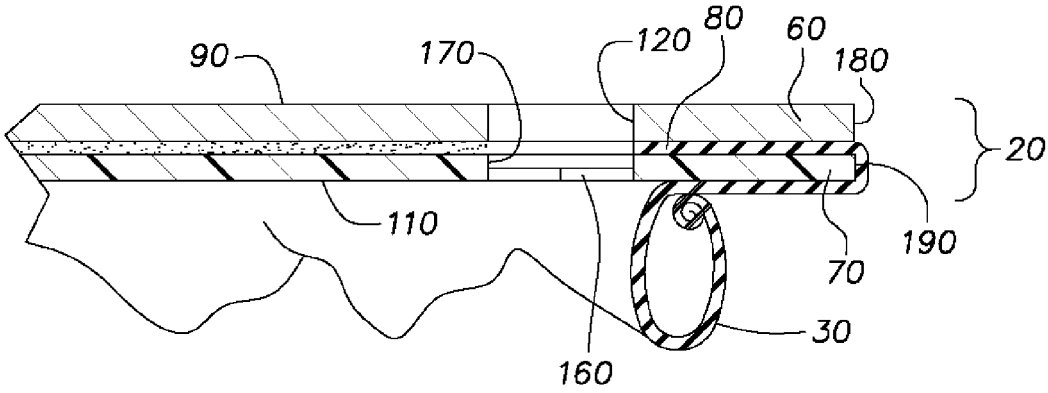
FIG. 7 is a side section view of a cap in which the upper disk portion and the lower disk portion have co-extensive perimeter edges.

It will be appreciated that the upper disk portion 60 needs to be at least the same size as the lower disk portion 70. FIG. 7 shows a section view of a cap 10 wherein the upper disk portion 60 has a first perimeter edge 180, wherein the lower disk portion 70 has a second perimeter edge 190, and wherein the first perimeter edge 180 is co-extensive with the second perimeter edge 190. More preferably, the upper disk portion 60 is larger than the lower disk portion 70, meaning that the first perimeter edge portion 180 of the upper disk portion 60 is spaced apart from the second perimeter edge portion 190 of the lower disk portion 70. In the preferred embodiment of the invention illustrated in FIG. 3, the first perimeter edge portion 180 of the upper disk portion 60 is spaced apart about ¼" (~6.4 mm) from the second perimeter edge portion 190 of the lower disk portion 70.

The tubular membrane 30 is preferably formed of a stretchy, resilient, flexible material such as a thin film of natural latex rubber, silicone or a polyurethane elastomer. In the preferred embodiment, the membrane 30 is fluid impermeable. Natural latex rubber having a thickness similar to that used in the manufacture of surgical gloves is particularly preferred.

As noted, the first end portion 80 of the tubular membrane 30 is captured between the upper disk portion 60 and the lower disk portion 70. Preferably, the adhesive used to join the upper disk portion 60 and the lower disk portion 70 together also helps secure the first end portion 80 of the tubular membrane 30 to the cover disk assembly 20. The second end portion 200 of the tubular membrane 30 preferably defines a ring, which facilitates rolling the tubular membrane 30 upwardly toward the lower disk portion 70.

Figure 5:
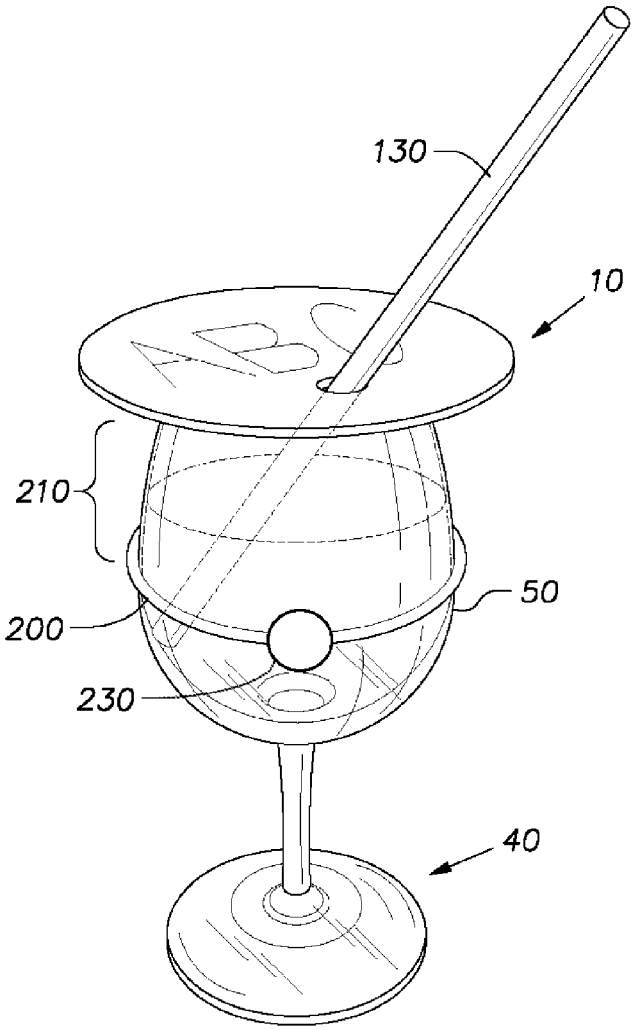
FIG. 5 is a perspective view of the cap shown in FIG. 1 deployed on a drinking vessel.
Figure 6:
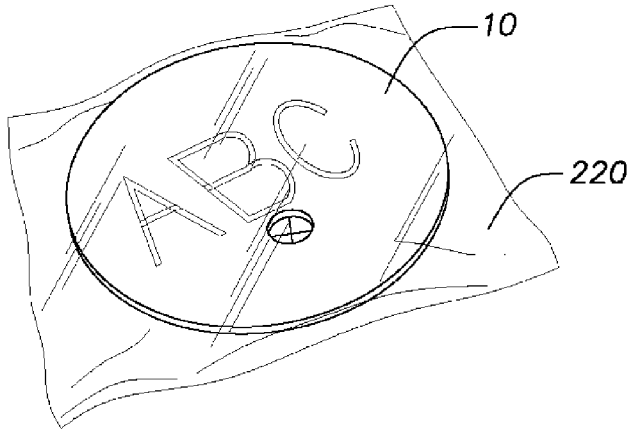
FIG. 6 is a perspective view of a package containing a cap such as shown in FIG. 1.

The tubular membrane 30 is selectively displaceable from a first position to a second position. In the first position, which is shown in FIGS. 1-4, the tubular membrane 30 is rolled about the ring disposed at the second end portion 200 upwardly toward the lower disk portion 70. In the second position, which is shown in FIG. 5, the tubular membrane 30 is unrolled to cover and surround the outer side wall 50 of a drinking vessel 40 and thereby form skirting 210. The flexible, elastic properties of the tubular membrane 30 cause the skirting 210 to conform to and closely surround the outer side wall 50 of the drinking vessel 40. When completely unrolled, the skirting 210 preferable has a height "H" of about 2.5" (~6.4 cm) to about 4.5" (~11.4 cm).

The cap 10 according to the invention can be packaged in a pouch 220 or other suitable protective enclosure prior to use. Optionally, the pouch can further contain a drinking straw 130, which may be a telescoping drinking straw. The tubular membrane 30 should be in the first position when placed in the pouch 220. The pouch 220 containing the cap 10 according to the invention can be kept in a pocketbook or garment pocket until needed. It will be appreciated that the pouch 220 can be imprinted with advertising indicia, making it particularly suitable for use as a promotional product. A variety of sizes of caps 10 can be produced and inventoried for use with drinking vessels having openings of varying size.

To use the cap according to the invention, a patron or beverage preparer first removes the cap from its protective pouch. The cap is placed onto a drinking vessel containing the beverage. With the tubular membrane in the first position, the cap is placed onto the open-top portion of the drinking vessel such that the lower disk portion is in contact with or nearly in contact with the top portion of the drinking vessel (e.g., the rim or the top of a beverage can). The rolled-up tubular membrane is then grasped and stretched and pulled down around the outer perimeter of the drinking vessel until the lower disk portion of the cover disk assembly adequately covers the open top portion of the drinking vessel. Next, the tubular membrane is unrolled down around the outer side wall of the drinking vessel, thereby surrounding the outer side wall of the drinking vessel with the skirt portion of the tubular membrane as shown in FIG. 5. If desired, an easy-to-tear, tamper-evident adhesive label 230 can be applied to secure the second end portion of the tubular membrane to the outer side wall of the drinking vessel. A drinking straw is then inserted through the first opening through the upper disk portion and the second opening through the lower disk portion of the cover disk assembly.

Once deployed, the cap prevents unwanted matter (e.g., insects and drugs) from entering the drinking vessel. The cap inhibits would-be criminals and others from adding unwanted substances to the beverage contained within the drinking vessel. It takes time for a person to unroll, remove, and then redeploy the cap onto a drinking vessel. Furthermore, removing the cap from a drink is a conspicuous act. Finally, in the event that a tamper-proof label has been applied to secure the tubular membrane to the outer side wall of the drinking vessel, removal of the cap from the drinking vessel will be evident.

It will be appreciated that the deployed cap also helps to minimize spills and broken glassware. The skirt portion of the membrane provides a comfortable non-slip gripping surface.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A selectively removable cap for covering an opening of a drinking vessel, the cap comprising:

a substantially rigid cover disk assembly for covering the opening of the drinking vessel; and a flexible tubular membrane having a first end portion and a second end portion;

wherein the cover disk assembly comprises an upper disk portion and a lower disk portion that are adhered together to capture the first end portion of the tubular membrane therebetween and thereby secure the first end portion of the tubular membrane to the cover disk assembly, wherein the tubular membrane is selectively displaceable from a first position to a second position, wherein in the first position the tubular membrane is rolled about a ring disposed at the second end portion of the tubular membrane upwardly toward the lower disk portion, and wherein in the second position the tubular membrane is unrolled to cover and surround an outer side wall of the drinking vessel and thereby form a skirting that conforms to and closely surrounds the outer side wall of the drinking vessel.

2. The cap according to claim 1 wherein the upper disk portion is formed of paperboard.

3. The cap according to claim 1 wherein the lower disk portion is formed of plastic.

4. The cap according to claim 1 wherein the cover disk assembly is provided with a hole through which an end of a drinking straw can pass.

5. The cap according to claim 1 wherein the upper disk portion is provided with a first opening through which a drinking straw can pass.

6. The cap according to claim 5 wherein the first opening is circular.

7. The cap according to claim 5 wherein the lower disk portion is provided with a plurality of intersecting slits that define a second opening through which the drinking straw can pass.

8. The cap according to claim 7 wherein the plurality of intersecting slits form a plurality of flaps, which are adapted to bias against the drinking straw when the drinking straw is passed through the second opening.

9. The cap according to claim 7 wherein the plurality of intersecting slits are formed in a recessed area of the lower disk portion.

10. The cap according to claim 1 wherein a top side of the cover disk assembly is provided with indicia.

11. The cap according to claim 1 wherein the upper disk portion has a first perimeter edge, wherein the lower disk portion has a second perimeter edge, and wherein the first perimeter edge is co-extensive with the second perimeter edge.

12. The cap according to claim 1 wherein the upper disk portion has a first perimeter edge, wherein the lower disk portion has a second perimeter edge, and wherein the first perimeter edge extends outwardly beyond the second perimeter edge.

13. The cap according to claim 1, wherein the cap is sealed within a protective pouch.

14. A selectively removable cap for covering an opening of a drinking vessel, the cap comprising:

a substantially rigid cover disk assembly for covering the opening of the drinking vessel; and a flexible tubular membrane having a first end portion and a second end portion;

wherein the cover disk assembly comprises a paperboard upper disk portion and a plastic lower disk portion that are joined together using an adhesive to capture the first end portion of the tubular membrane therebetween and thereby secure the first end portion of the tubular membrane to the cover disk assembly, wherein the tubular membrane is selectively displaceable from a first position to a second position, wherein in the first position the tubular membrane is rolled about a ring disposed at the second end portion of the tubular membrane upwardly toward the lower disk portion, wherein in the second position the tubular membrane is unrolled to cover and surround an outer side wall of the drinking vessel and thereby form a skirting that conforms to and closely surrounds the outer side wall of the drinking vessel, wherein a first perimeter edge of the upper disk portion extends outwardly beyond a second perimeter edge of the lower disk portion, wherein the upper disk portion is provided with a circular first opening through which a drinking straw can pass, wherein the lower disk portion is provided with a plurality of intersecting slits that define a second opening through which the drinking straw can pass, wherein the plurality of intersecting slits form a plurality of flaps, which are adapted to bias against the drinking straw when the drinking straw is passed through the second opening, wherein the plurality of intersecting slits are formed in a recessed area of the lower disk portion, and wherein a top side of the cover disk assembly is provided with indicia.

15. A method for inhibiting the unwanted addition of matter into a beverage contained in a drinking vessel, the method comprising:

providing a cap comprising a substantially rigid cover disk assembly adapted to cover the opening of the drinking vessel, and a flexible tubular membrane having a first end portion and a second end portion, wherein the cover disk assembly comprises an upper disk portion and a lower disk portion that are adhered together to capture the first end portion of the tubular membrane therebetween and thereby secure the first end portion of the tubular membrane to the cover disk assembly, wherein the tubular membrane is rolled about a ring disposed at the second end portion of the tubular membrane upwardly toward the lower disk portion;

placing the cap onto the drinking vessel to cover an opening in the drinking vessel; and unrolling the tubular membrane to cover and surround the outer side wall of the drinking vessel and thereby form a skirting that conforms to and closely surrounds the outer side wall of the drinking vessel.

16. The method according to claim 15 further comprising inserting a drinking straw through a hole in the cover disk assembly.

17. The method according to claim 15 further comprising adhering a label to both the tubular membrane and the outer side wall of the drinking vessel, wherein the label is adapted to tear apart in the event that the cap is removed from the drinking vessel.

18. The method according to claim 15 wherein the cap is removed from a protective pouch before it is placed onto the drinking vessel.

19. The method according to claim 15 wherein the drinking vessel is selected from the group consisting of a tumbler, a piece of stemware or a pop-top beverage can.

* * * * *